United States Patent [19]

Leifeld

[11] Patent Number: 4,742,675

[45] Date of Patent: May 10, 1988

[54] METHOD AND APPARATUS FOR PRODUCING A UNIFORM, CONTINUOUS FIBER QUANTITY

[75] Inventor: Ferdinand Leifeld, Kempen, Fed. Rep. of Germany

[73] Assignee: Trützschler GmbH & Co. KG, Monchen-Gladbach, Fed. Rep. of Germany

[21] Appl. No.: 750,766

[22] Filed: Jul. 1, 1985

[30] Foreign Application Priority Data

Jul. 10, 1984 [DE] Fed. Rep. of Germany ..... 3425345

[51] Int. Cl.[4] ..... D01H 7/895; D01G 23/06

[52] U.S. Cl. ..... 57/412; 19/105; 19/240; 57/90; 57/408

[58] Field of Search ..... 57/400, 90, 404, 408, 57/91, 412, 405; 19/239, 240, 300, 105, 106 R

[56] References Cited

U.S. PATENT DOCUMENTS

| | | | |
|---|---|---|---|
| 2,725,599 | 12/1955 | Schorsch et al. | 19/65 |
| 2,843,882 | 7/1958 | Lewis et al. | 19/240 |
| 3,038,293 | 6/1962 | Pavek | 57/408 X |
| 3,157,915 | 11/1964 | Gilbo | 19/106 |
| 3,355,869 | 12/1967 | Vorisek | 57/408 X |
| 3,709,406 | 1/1973 | Binder et al. | 19/240 X |
| 3,855,772 | 12/1974 | Burlet | 57/408 X |
| 4,271,565 | 1/1981 | Grunder | 19/240 |
| 4,275,483 | 6/1981 | Roberson | 19/240 |
| 4,379,386 | 4/1983 | Goldammer et al. | 57/405 |
| 4,393,547 | 7/1983 | Hosel | 19/105 |
| 4,438,548 | 3/1984 | Grunder | 19/240 X |
| 4,506,413 | 3/1985 | Leifeld | 19/105 |

FOREIGN PATENT DOCUMENTS

| | | |
|---|---|---|
| 1043886 | 11/1958 | Fed. Rep. of Germany . |
| 1097328 | 6/1961 | Fed. Rep. of Germany . |
| 1510450 | 2/1969 | Fed. Rep. of Germany . |
| 2031788 | 2/1972 | Fed. Rep. of Germany . |
| 2320369 | 11/1973 | Fed. Rep. of Germany . |
| 2506058 | 9/1976 | Fed. Rep. of Germany . |
| 2912576 | 10/1979 | Fed. Rep. of Germany . |
| 2905589 | 8/1980 | Fed. Rep. of Germany . |
| 3244619 | 10/1983 | Fed. Rep. of Germany . |
| 383842 | 1/1965 | Switzerland . |

OTHER PUBLICATIONS

Derichs "Die Automatisierung der Rotorspinnmaschine", Mellian Textilberichte 60 (1979) 539–545.

Polke et al., "Stand und Entwicklung der Prozessleittechnik für die Textilindustrie" Melliand Textilberichte 5/1984, pp. 291–297.

*Primary Examiner*—John Petrakes

*Attorney, Agent, or Firm*—Spencer & Frank

[57] ABSTRACT

A yarn making machine assembly includes a yarn spinning chamber; a feed table adapted to support a silver thereon; a feed roller having a periphery defining, with the feed table, a clearance through which the sliver is adapted to pass; an rpm-variable motor connected to the feed roller for rotating it to advance the sliver; an opening roller arranged adjacent the clearance to receive the sliver and to break it up into fibers; a sliver thickness sensor including the feed roller and/or the feed table to execute excursions in response to thickness variations in the sliver running through the clearance; a device for generating an electric signal as a function of the excursions; a regulator for receiving the electric signal and for emitting a setting signal as a function of a difference between desired and actual thickness values of the sliver; and a device for applying a signal, representing the setting signal, to the motor for varying the rpm thereof to thus alter the rotational speed of the feed roller, whereby the thickness of the sliver admitted to the opening roller from the clearance is rendered uniform.

16 Claims, 2 Drawing Sheets

METHOD AND APPARATUS FOR PRODUCING A UNIFORM, CONTINUOUS FIBER QUANTITY

BACKGROUND OF THE INVENTION

This invention relates to a method and an apparatus for producing a uniform, continuous fiber quantity for improving the uniformity of a yarn made, for example, in an open-end spinning, friction spinning or air spinning process in which the sliver from which the yarn is to be spun is introduced into a rapidly rotating opening roller of the spinning machine and wherein the sliver passes through a clearance defined by a rotating feed roll and a feed table.

In the spinning technology, for example, in open-end spinning, friction spinning or air spinning, fluctuations in the properties of the sliver are conventionally corrected in the card and/or the drawing frame during fiber processing preparatory to spinning. During the subsequent processing of the drawn sliver, such as breaking up the sliver into individual fibers and feeding the fibers to the yarn making element such as a rotor, fluctuations of the fiber quantities disadvantageously result in deviations from a desired weight per unit length (desired thickness value). The final undesired result is a non-uniform yarn which manifests itself, for example, in thickened or thinned yarn lengths.

SUMMARY OF THE INVENTION

It is an object of the invention to provide an improved method and apparatus of the above-outlined type for producing a uniform, continuous fiber quantity to be admitted to a yarn making device.

This object and others to become apparent as the specification progresses, are accomplished by the invention, according to which, briefly stated, at the location between the feed roller and the feed table the weight per length unit, that is, the thickness of the sliver is mechanically measured, an electric signal representing the sensed physical magnitudes is generated, deviations from a desired sliver weight per unit (thickness) is determined, setting signals are generated as a function of the deviation, and the rpm of the feed roller is varied by the setting signals.

Thus, according to the invention, at a spinning location the feed roller which is located upstream of an opening roller is varied in its rpm as a function of the thickness of the throughgoing sliver in such a manner that in case of a thickening of the sliver the feed roller rotates slower and in case of a thinner sliver portion the feed roller rotates more rapidly. The thickness of the throughgoing sliver is measured at the bite of the feed roller upstream of the opening roller. In this manner a correction of the yarn thickness of the produced yarn is effected as a function of the fluctuations of the material mass of the sliver which is the product of a card or a drawing frame. Because delay periods are absent (which may appear in regulating systems) and because no handling of the material takes place prior to producing fibers from the sliver (such handling could introduce errors), the correction of the sliver thickness at the feed roller just upstream of the opening roller is an ideal location for correction, and fiber quantity fluctuations may be reduced to the mininum possible value. The method according to the invention may find application in all spinning systems which involve sliver opening such as open end spinning, friction spinning, air spinning, and the like.

The apparatus according to the invention has a sliver feeding arrangement which is situated upstream of a rapidly rotating sliver opening roller and which has a feed roller and a feed table, one or both of which have a measuring sensor operatively coupled with the intermediary of a regulator, to an rpm-variable drive motor of the feed roller. Preferably, for each spinning station individual drives as well as a measuring system are used, the latter preferably including sensors and electronic components.

According to a preferred embodiment of the invention, the feed table is spring-biased for pressing the throughgoing sliver against the rotating feed roller. According to a further feature of the invention, the sensor comprises an inductive plunger coil or a sliding resistance. According to still another preferred embodiment of the invention, with the feed table there is associated a piezoelectric pressure sensor situated preferably between the feed table and a machine housing. According to a further feature of the invention, an amplifier is arranged between the sensor and the regulator. According to still another feature of the invention, an rpm setter is arranged between the regulator and the drive motor for the feed roller. According to still another feature of the invention, each feed roller is associated with its own, separate drive.

DESCRIPTION OF THE PREFERRED EMBODIMENTS

Figure 1:
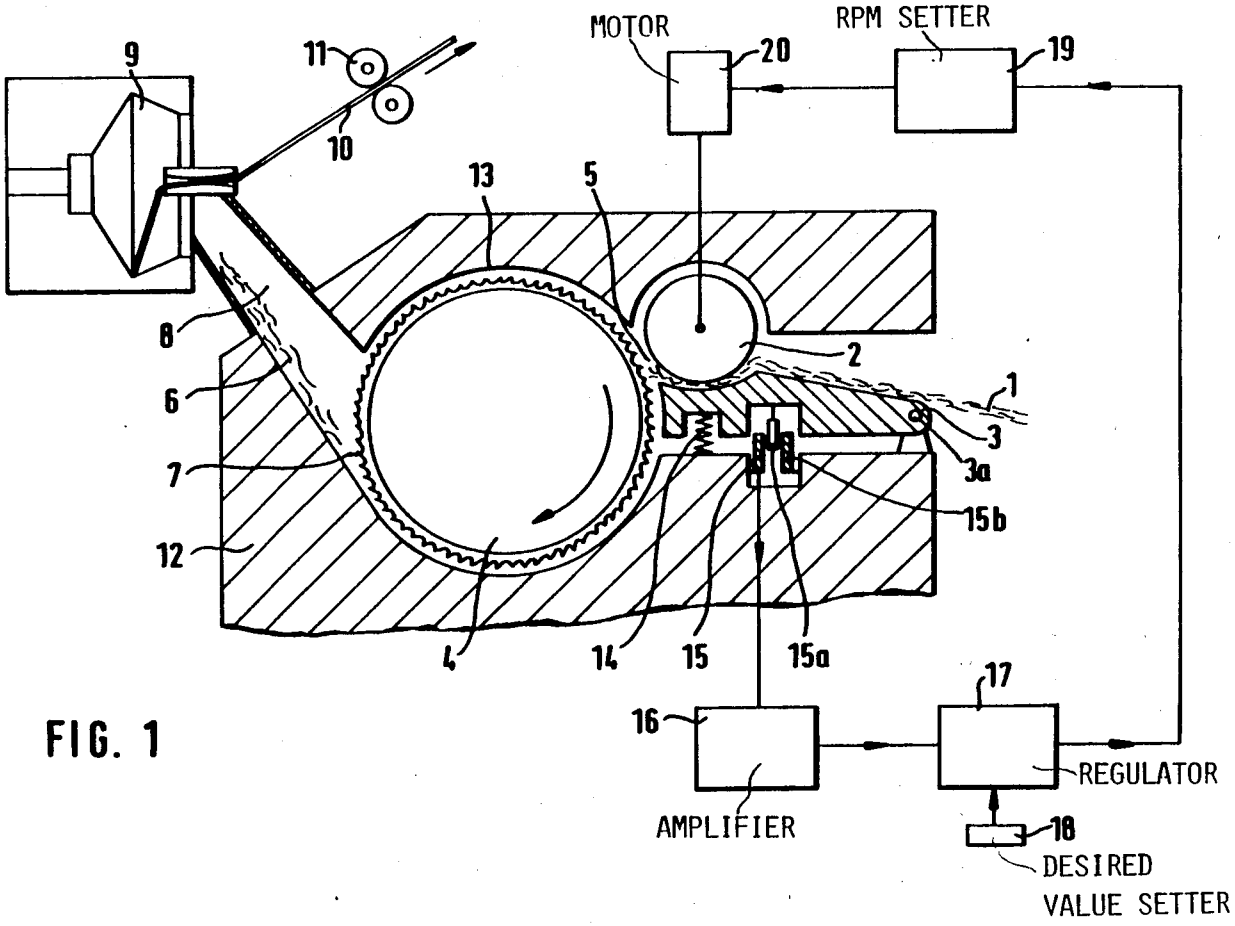
FIG. 1 is a schematic sectional side elevational view of a preferred embodiment of the invention.

Turning to FIG. 1, a sliver 1 is introduced into a clearance (bite) formed between a feed roller 2 and a feed table 3 and is delivered, at a sliver delivery point 5, to a rapidly rotating opening roller 4 which opens the sliver to form individual fibers 6 therefrom. Opening rollers 4 of this type are provided on their periphery with needles or other type of clothing. The fibers 6 are advanced through a supply channel 8 to a spinning chamber 9 of a yarn making apparatus. The fibers 6 are deposited in the collecting groove of the spinning chamber 9 to form a fiber ring and are, by means of a delivery device 11 drawn off the spinning chamber 9 as a spun yarn.

The opening roller 4 is surrounded by a housing 12 whose wall 13 is adapted to the curvature of the opening roller 4 and forms a narrow clearance therewith. The wall 13 thus constitutes a guiding surface for the fibers 6.

The sliver 1 is pulled in by virtue of the cooperation of the feed roller 2 and the feed table 3 and is first admitted to the sliver supply location 5 where the sliver is grasped by the opening roller 4 and tears the sliver 1 into individual fibers 6 by means of its clothing which thus combs and opens the sliver. The fibers 6 are entrained by the opening roller 4 and are admitted to a fiber removal station 7 where they enter a fiber supply channel 8 by virtue of a vacuum prevailing in the spinning chamber 9.

The feed table 3 is, at one end, pivotally mounted on the housing 12 at 3*a* and is elastically supported by a spring 14 which is backed up by the housing 12. By virtue of this arrangement the sliver 1 is pressed against the periphery of the feed roller 2 by the feed table 3.

To the underside of the feed table 3 there is secured an armature 15*a* which cooperates with a coil 15*b* mounted on the housing 12. The armature 15*a* and the coil 15*b* constitute a plunger coil type sensor 15. The coil 15b is electrically connected by means of an amplifier 16 with a regulator 17 which includes a desired value setter 18. The output of the regulator 17 is connected with an rpm setter 19 which, in turn, is coupled to a drive motor 20 which rotates the feed roller 2. Thus, at the location where the sliver runs through the feed roller 2 and the feed table 3, the thickness of the sliver is continuously sensed by virtue of the pivotal feed table 3 which assumes a distance from the feed roller 2 as a function of the momentary thickness of the sliver 1. Any displacement of the feed table 3 causes the armature 15*a* to change its position with respect to the plunger coil 15*b* which, because of a change in the inductivity, generates an electric signal. The latter is applied, via the amplifier 16, to the regulator 17 which compares the desired value (set in the desired value setter 18) with the actual value and, as a function of the difference, generates an electric regulating signal which is applied to the rpm-variable drive motor 20 via the rpm setter 19. The rpm of the drive motor 20 is thus varied as a function of the sliver thickness and, as a result, if the deviation is positive (that is, the sensed thickness is greater than the desired thickness) the feed roller will rotate slower and, conversely, if the deviation has a negative value (that is, the sensed thickness is less than a desired thickness) the feed roller will be caused to rotate more rapidly. Thus, a thickness correction of the sliver 1 is effected such that the opening roller 4 will receive, in the first instance, a thinner and, in the second instance, a thicker sliver 1, as compared to the sliver thicknesses at the inlet to thus introduce into the opening roller 4 a sliver whose thickness is uniform and corresponds to the set desired thickness value. Thus, a uniform quantity of fiber 6 is delivered in a continuous flow to the spinning chamber 9.

Figure 2:
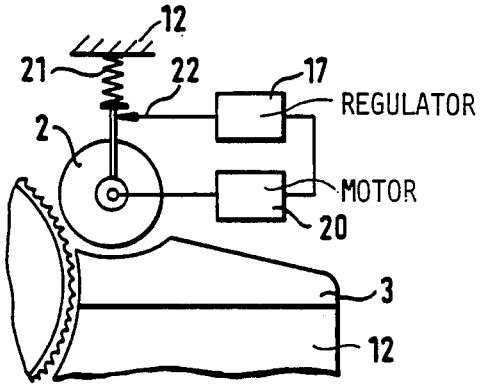
FIG. 2 is a schematic side elevational view of another preferred embodiment of the invention.

According to a variant illustrated in FIG. 2, the feed roller 2 is elastically supported by a spring 21 on the housing 12, while the feed table 3 is fixedly mounted thereon. The measuring sensor in this embodiment is formed of an electric sliding rheostat 22 which is connected with the rpm-variable drive motor 20 of the feed roller 2 with the intermediary of the regulator 17.

Figure 3:
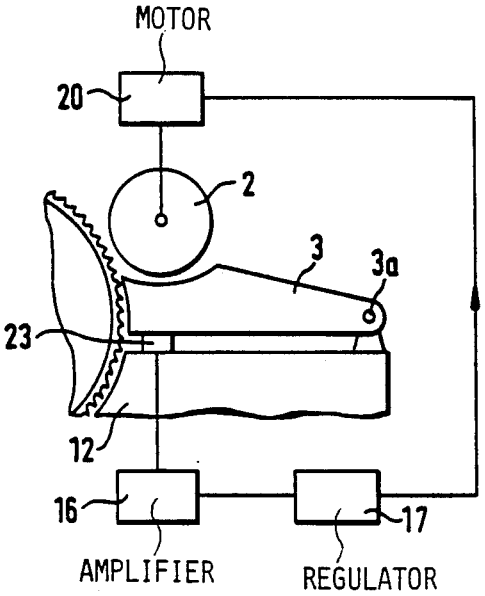
FIG. 3 is a schematic side elevational view of still a further preferred embodiment of the invention.

Turning now to FIG. 3, in the embodiment illustrated therein the feed table 3 is, similarly to the FIG. 1 embodiment, pivotally supported at 3*a*. Between the underside of the feed table 3 and the housing 12 there is arranged a piezoelectric pressure sensor 23 which is connected with the rpm-variable drive motor 20 of the feed roller 2 by means of the amplifier 16 and the regulator 17. In this embodiment, in case the sensed sliver thickness is greater than the desired value, the feed table 3 is pressed downwardly about its rotary axis 3*a* whereby an additional pressure is exerted on the piezoelectric pressure sensor 23. The pressure oscillations are directly converted into electric signals by the piezoelectric pressure sensor 23 and are applied, via the amplifier 16, to the regulator 17 which generates corresponding electric setting signals for the drive motor 20. The same applies conversely, that is, when the sensed thickness values are less than a desired value, in which case the pressure applied to the piezoelectric sensor 23 by the feed table 3 is reduced.

It is within the scope of the invention to use other appropriate measuring sensors for detecting deviations of the sliver thicknesses from a desired thickness or from a desired weight per unit length.

It will be understood that the above description of the present invention is susceptible to various modifications, changes and adaptations, and the same are intended to be comprehended within the meaning and range of equivalents of the appended claims.

What is claimed is:

1. In a method of supplying a continuous fiber quantity to a spinning mechanism of a yarn making apparatus, including the steps of passing a sliver through a clearance defined between a feed roller and a feed table cooperating with the feed roller; advancing the sliver by the feed roller to an opening roller; and advancing fiber from the opening roller to the spinning mechanism; the improvement comprising the following steps:

(a) sensing the thickness of the running sliver between the feed roller and the feed table;

(b) generating an electric signal representing the sensed thickness value;

(c) determining any deviation between desired and sensed thickness values;

(d) generating a setting signal representing the deviation; and (e) regulating the rpm of the feed roller as a function of the setting signal, whereby the thickness of the sliver admitted to the opening roller from the clearance is rendered uniform.

2. In a yarn making machine assembly including means defining a yarn spinning chamber; a feed table adapted to support a sliver thereon; a feed roller having a periphery defining, with said feed table, a clearance through which the sliver is adapted to pass; motor means connected to said feed roller for rotating said feed roller to advance the sliver through said clearance; an opening roller arranged adjacent said clearance to receive the sliver therefrom and to break up the sliver into fibers and means to advance the fibers into said yarn spinning chamber; the improvement comprising (a) a sliver thickness sensor including a movable component arranged to be contacted by the sliver in said clearance to execute excursions in response to thickness variations in the sliver running through said clearance;

(b) means for generating an electric signal as a function of the excursions of said component;

(c) regulator means for receiving said electric signal and for emitting a setting signal as a function of a difference between desired and actual thickness values of the sliver;

(d) an rpm-variable motor constituting said motor means; and (e) means for applying a signal, representing said setting signal, to said motor for varying the rpm thereof to vary the rotational speed of said feed roller, whereby the thickness of the sliver admitted to the opening roller from the clearance is rendered uniform.

3. A yarn making machine assembly as defined in claim 2, further comprising an amplifier having an input connected to said means for generating an electric signal and an output connected to said regulator means.

4. A yarn making machine assembly as defined in claim 2, further comprising an rpm setter having an input connected to said regulator means and an output connected to said drive motor.

5. A yarn making machine assembly as defined in claim 2, wherein said feed roller and said drive motor are present in a plurality; with each said feed roller there being associated a separate said drive motor.

6. A yarn making machine assembly as defined in claim 2, wherein said means for generating an electric signal comprises an inductive plunger coil-type sensor having an armature affixed to said movable component and a coil cooperating with said armature to generate said electric signal as a function of displacements of said armature.

7. A yarn making machine assembly as defined in claim 6, further comprising means for movably supporting said feed table to provide displaceability thereof towards and away from said feed roller, and wherein said movable component is constituted by said feed table.

8. A yarn making machine assembly as defined in claim 2, wherein said means for generating an electric signal comprises a sliding resistance operatively connected to said component.

9. A yarn making machine assembly as defined in claim 8, further comprising means for radially movably supporting said feed roller to provide displaceability thereof towards and away from said feed table; said movable component being constituted by said feed roller.

10. A yarn making machine assembly as defined in claim 2, further comprising means for movably supporting said feed table to provide displaceability thereof towards and away from said feed roller, and wherein said movable component is constituted by said feed table.

11. A yarn making machine assembly as defined in claim 10, further comprising a spring urging said feed table toward said feed roller.

12. A yarn making machine assembly as defined in claim 2, further comprising means for radially movably supporting said feed roller to provide displaceability thereof towards and away from said feed table; said movable component being constituted by said feed roller 13. A yarn making machine assembly as defined in claim 12, further comprising a spring urging said feed roller towards said feed table.

14. A yarn making machine assembly as defined in claim 2, wherein said means for generating an electric signal comprises a piezoelectric element operatively connected to said component for being exposed to pressures derived from said excursions.

15. A yarn making machine assemblY as defined in claim 14, further comprising means for movably supporting said feed table to provide displaceability thereof towards and away from said feed roller, and wherein said movable component is constituted by said feed table.

16. A yarn making machine assembly as defined in claim 15, further comprising a housing supporting said feed roller and said feed table; said piezoelectric element is situated between said housing and said feed table.

* * * * *